United States Patent [19]

Glaser et al.

[11] 4,427,479

[45] Jan. 24, 1984

[54] FLAT-PANEL DISPLAY AND METHOD OF MANUFACTURE

[76] Inventors: David Glaser, 1918 Raymond Dr., Northbrook, Ill. 60062; Charles J. Whelchel, 1564 Cove Dr., Prospect Heights, Ill. 60070

[21] Appl. No.: 336,547

[22] Filed: Jan. 4, 1982

Related U.S. Application Data

[62] Division of Ser. No. 182,782, Aug. 29, 1980, Pat. No. 4,339,482.

[51] Int. Cl.[3] ..... H01J 9/26; H01J 9/39

[52] U.S. Cl. ..... 156/286; 156/89; 156/292; 156/300; 313/583; 313/584; 313/586; 313/587; 313/635; 445/16; 445/22; 445/23; 445/25; 445/29; 445/44

[58] Field of Search ..... 156/89, 286, 292; 445/16, 22, 23, 25, 29, 44; 313/583, 584, 586, 313/587, 634, 635; 428/34; 156/300

[56] References Cited

U.S. PATENT DOCUMENTS

| | | | |
|---|---|---|---|
| 3,330,982 | 7/1967 | Dickson | 445/25 |
| 3,900,935 | 8/1975 | Caras | 156/89 |
| 4,303,847 | 12/1981 | Glaser | 313/540 |

*Primary Examiner*—Jerome W. Massie
*Attorney, Agent, or Firm*—Edmond T. Patnaude

[57] ABSTRACT

A flat-panel display is constructed by sealing a metal flange to a frame on a glass pane, then mounting an electrode structure against the pane within the frame, then placing an impervious malleable sheet over the electrode structure, then sealing the sheet to the flange, and then pumping air from the space between the sheet and the glass pane, and backfilling as required.

7 Claims, 8 Drawing Figures

FLAT-PANEL DISPLAY AND METHOD OF MANUFACTURE

This is a division of application Ser. No. 06/182,782, filed Aug. 29, 1980, now U.S. Pat. No. 4,339,482.

The present invention relates in general to luminescent flat-panel displays and to methods of manufacturing such panels, and it relates in particular to an improvement of the invention disclosed in application Ser. No. 06/051,152 filed June 22, 1979, and assigned to the same assignee as is the present invention.

BACKGROUND OF THE INVENTION

The above-identified copending application discloses a flat-panel display in which a compliant display-producing electrode structure is held against the rear face of a glass panel by a thin, impervious, malleable sheet which overlies the electrode structure and is hermetically sealed to the panel through a continuous area surrounding the viewing area of the glass panel. The hermetic seal described in the said application is formed by a conventional glass-to-metal sealing process which is carried out at high temperatures of the order of 400° C. to 800° C. after the electrode structure has been mounted in the panel. Consequently, the electrode structure must withstand the high temperatures required to effect the necessary glass-to-metal seal. This requisite has severely restricted the choice of materials available for use in the electrode structure, and has also limited the types of electrode structures which may be used. For example, because of the expansion and subsequent contraction of the components of the panel, thermal matching of the components is desirable.

SUMMARY OF THE INVENTION

Briefly, there is provided in accordance with the present invention an improved modification of the panel and method of fabrication thereof which enables the use of electrode structures, components and materials which are unable to withstand high temperatures such as those required to effect glass-to-metal seals, which temperatures are ordinarily in the range of 400° C. to 600° C. but are higher where borosilicate glass is used. In keeping with one aspect of the invention, a thin metal flange is initially sealed to a continuous area of the glass panel surrounding the window or viewing area by any suitable glass-to-metal sealing method. Thereafter, the electrode structure is positioned over the viewing area of the glass panel, a compressible insulating blanket and a metal foil rear sheet are placed over the electrode structure, and the rear metal sheet is hermetically sealed to the flange in a welding or other suitable low-temperature or localized heating operation wherein the temperatures of the electrode structures need not be appreciably raised above ambient. The pressure in the cavity which is located between the rear sheet and the glass panel and which contains the electrode structure is then reduced to below ambient pressure whereby the electrode structure is compressed against the glass panel by the rear sheet.

It may thus be seen that the electrode structure need not be subjected to temperature exceeding the normal operating temperatures of the panel, thereby facilitating the design and manufacture of the electrode structure and of the panel.

GENERAL DESCRIPTION OF THE DRAWINGS

The present invention will be better understood by a reading of the following detailed description taken in connection with the accompanying drawings wherein.

DETAILED DESCRIPTION OF THE INVENTION

The present invention constitutes an improvement of the flat-panel displays and methods of manufacture disclosed in copending application Ser. No. 06/051,152 filed June 22, 1979, and the specification and drawings of that application are incorporated herein by reference. This invention may be used with many different types of displays including, inter alia, plasma-discharge panels, cathodoluminescent panels, electroluminescent panels, liquid-crystal panels, electrophoretic panels and electrochomic panels.

Irrespective of the type of panel, however, a flat-panel display embodying the present invention utilizes a front glass sheet or pane, a substantially compliant or comformable electrode structure positioned against the rear face of the glass pane over the window or viewing area thereof, and a thin, substantially gas-impervious, malleable rear sheet which covers the rear side of the blanket. Although not necessary, a compressible pad or blanket covering the rear of the electrode structure and located directedly beneath the rear sheet is preferred. If the internal structure is such that substantial gaps or voids exist into which the rear foil or blanket may be drawn, a screen or pliable perforated metal support may be interposed between the blanket and foil and the internal structure so as to provide a bridge or brace over the void. This brace supports the blanket and foil against being pushed into the void by the external pressure. The rear sheet is then sealed to a metal flange, which flange was hermetically sealed to the glass pane in a previous sealing operation prior to mounting of the electrode structure to the glass pane. The space between the glass pane and the rear sheet is then evacuated and may be back-filled with a suitable gas if the particular type of display system used requires back-filling. The pressure in the cavity is normally maintained below ambient wherefor the rear sheet is drawn toward the glass pane and holds the electrode structure in a fixed position against the glass pane. The cavity in which the electrode structure is located is thus sealed from the ambient without the exertion of any substantial tensile, sheer or compressive forces on the glass pane. Moreover, the glass pane thus provides the primary support member in the panel, and the seals between the glass pane and the metal flange and between the rear sheet and the metal flange are not support members nor are any substantial stresses exerted on these seals during either the manufacture or use of the panel.

The manner in which the panel is evacuated and back-filled does not constitute a part of this invention but may be carried out in any suitable manner including those disclosed in the said copending application.

Figure 1:
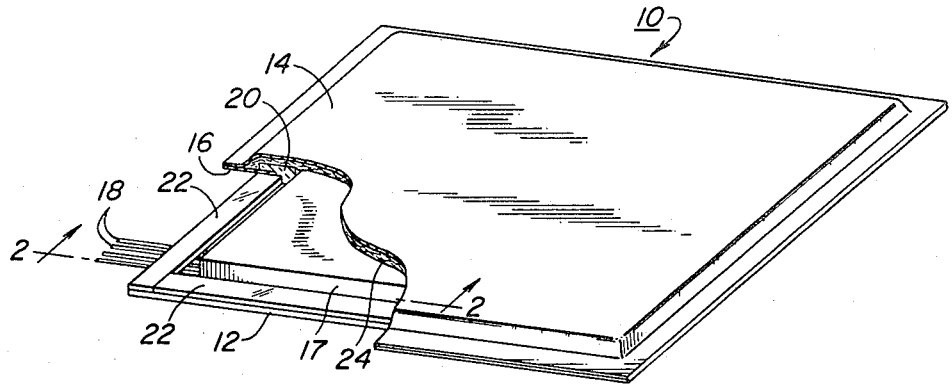
FIG. 1 is a perspective view, partly broken away, of the rear side of a flat-panel display embodying the present invention.

Referring particularly to FIG. 1, a flat-panel display is generally identified by the reference character 10 and comprises a glass pane 12 at the front (bottom as viewed in FIG. 1) and a gas-impervious, malleable rear sheet 14. The central portion of the sheet 14 overlies the display-producing electrode structure 17 which is disposed against the rear face of the glass pane 12. The peripheral area of the sheet 14 is hermetically sealed to a metal flange 16 which is hermetically sealed to the glass pane throughout a continuous area surrounding the electrode structure 17. A plurality of electric conductor elements or leads 18 which may be screened onto the pane 12 sealably extend into the cavity within the panel and are electrically connected to the appropriate elements in the electrode structure. These leads extend from the panel and may be connected to the control circuits for the panel.

Figure 2:
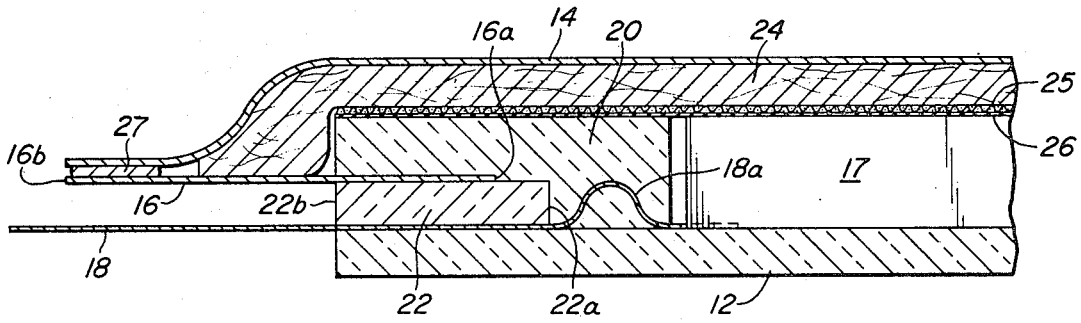
FIG. 2 is a fragmentary, cross-sectional view taken along the line 2—2 of FIG. 1.

As best shown in FIG. 2, the flange 16 is hermetically sealed to the glass pane 12 by a frit-type seal 20. Considered in greater detail, four glass strip members 22 are laid over the glass pane along the four side edges thereof. The leads 18 extend between one or more of these strips and the underlying surface of the glass pane 12. For convenience of assembly the leads may be tack-glued to the pane with a suitable cement. The flange 16 is a continuous flat member formed of a gas-impervious material such as aluminum or copper foil, and it is placed on the strips 22 with its inner edge **16*a* spaced outwardly from the inner edges 22*a* of the frame strips 22 and with its outer edges 16*b* positioned a substantial distance outwardly of the outer edges 22*b* of the strips 22. For convenience, the flange 16 may be tack-glued to the frame strips. A moat, not shown, is then used to hold the frit in place while the frit seal bead 20 is effected. The sealing bead hermetically seals the frame pieces 22 to the pane 12 and to the flange member 16. If the leads 18 are separate wires they may be provided with an intermediate loop portion 18*a* to permit the molten frit to flow thereunder during the sealing operation so as to effect a hermetic seal to the leads 18**. Inasmuch as the sealing process requires the melting of the frit, it is usually carried out at a high temperature exceeding 400° C.

After the glass pane 12 has cooled to substantially ambient temperature the electrode structure 17 is positioned on the rear face of the glass pane 12 over the display area or window of the panel, and the leads 18 are suitably connected thereto. As is explained in the said application, it is desirable that the electrode structure 17 be compliant so that it will readily conform to the rear face of the pane 12 when subsequently pressed against it. With the electrode structure thus positioned on the pane 12, a thin insulating sheet 26 is placed over the display-producing structure 17 and a stress-distributing and bridging member such as wire-mesh screen 25 is placed over the insulating sheet. The sheet 26 may be a sheet of aluminium oxide paper having a thickness of twenty mils. Then a compressible insulating sheet 24, hereinafter called a blanket, is placed over the wire-mesh or perforated-metal screen 25. The blanket 24 extends outwardly beyond the outer sides of the frame strips 20 but with the outer edges of the blanket spaced inwardly from the outer edge of the flange 16. If desired, the blanket 24, the screen 25 and/or the insulator 26 may be omitted. The gas-impervious, malleable, thin sheet 14, which is preferably soft metal foil such as aluminum or copper foil, is placed over the rear side of the blanket 24, if used, otherwise it is placed over the rear side of the internal structure 17. The peripheral portion of the sheet 14 is then hermetically sealed to the peripheral portion of the flange 16 to provide a continuous seal. In FIG. 2 this seal is shown to be effected by a sealing bead 27 bonded to the adjacent surfaces of the sheet 14 and to the flange 16. However, other types of seals, such as butt seals, may be used. Where both the sheet 14 and the flange 16 are metal, they may be hermetically sealed together by welding. However, irrespective of the sealing method which is used, it is desirable that the temperature of the glass pane 12 and the electrode structure 17 not be changed appreciably during the sealing operation.

Upon subsequent evacuation of gasses from the space in which the electrode structure 17 is enclosed, the pressure differential across the rear sheet will cause it to be drawn downwardly over the electrode structure 17 and the overlying blanket 24 thereby to hold the electrode structure in the predetermined desired position against the glass pane 12.

Figure 3:
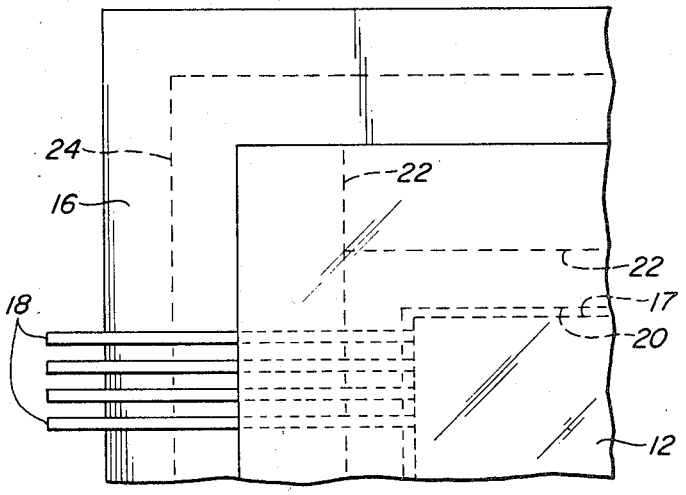
FIG. 3 is a bottom view of one corner of the flat-panel display shown in FIGS. 1 and 2.

As may be seen from an inspection of FIG. 3, the frit sealing bead 20 extends inwardly from the inner corners formed by the frame pieces 22 thereby to seal over the spaces at the corners between the frame member 22.

In FIG. 2 the rear surface of the electrode structure 17 is illustrated as being flat. However, it may have any configuration which, for example may be undulating or irregular.

Figure 4A:
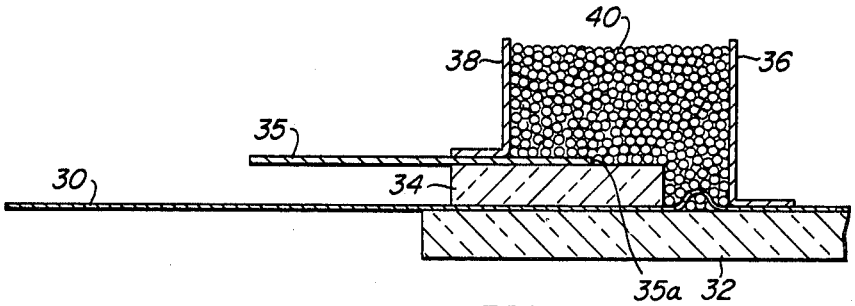
FIG. 4A is a fragmentary, cross-sectional view of another flat-panel display construction during the manufacturing process.
Figure 4B:
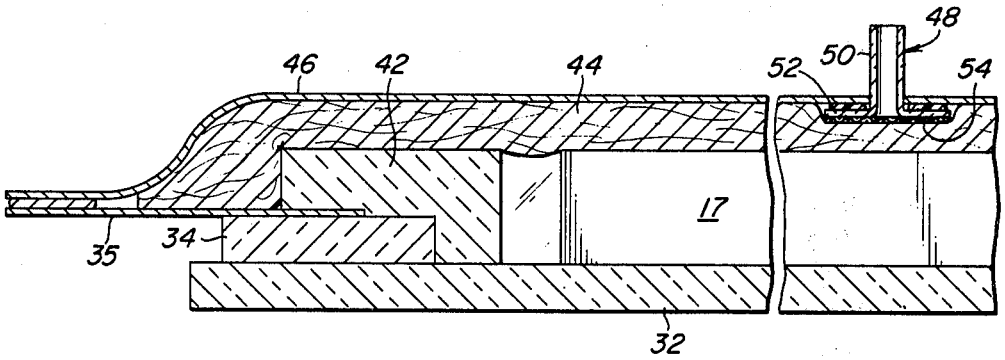
FIG. 4B is a fragmentary, cross-sectional view of the completed flat-panel display shown in process of manufacture in FIG. 4A.

Referring now to FIGS. 4A and 4B, there is shown one edge of a novel flat-panel display in two successive stages of manufacture. As shown in FIG. 4A, one of several metal leads 30 lies against the rear face of a glass pane 32 constituting the face and principal support member of the panel. A glass frame strip or member 34 rests on the leads 18 and on the pane 32 near the edge thereof. It will be understood that four such strips are provided and surround the viewing area of the pane 32 in the same manner in which the frame members 22 surround the viewing area of the pane 12 in FIGS. 1–3. A unitary, rectangular annular metal flange 35 is placed on the frame pieces 34, and if desired, the flange 35 is tack-glued to the frame pieces with a suitable cement. Pieces of metal foil or the like 36 and 38 are then used to form a moat into which powdered or slurried frit or other suitable sealant is placed. The inner metal foil piece 36 is located interiorly of the inner edges of the frame pieces, and the outer metal foil piece 38 is located outwardly of the inner edge **35*a* of the flange member 35. It may thus be seen that the most completely surrounds the central viewing area of the glass pane 32**.

With the moat filled with a suitable sealant such as frit, the entire assembly is placed in an oven and heated to the sealing temperature of the sealant for the necessary time to insure a hermetic seal to the pane 32, the leads 30, the frame pieces 34 and the flange member 35. After the panel has been cooled to about ambient temperature the foil pieces 36 and 38 are removed as by peeling them away without damaging the integrity of the seal. It should be noted that frit contracts a substantial amount when melted, wherefor the moat must be substantially deeper than the height of the final sealing bead 42 where frit is used as the sealant. The electrode structure 17 is then positioned over the viewing area of the glass pane 32 and a compressible pad or blanket 44 of insulating material may be placed thereover. A thin, malleable metal foil sheet 46 is then placed over the blanket 44 and the edge portions of the sheet 46 are hermetically sealed to the flange member 35 in any suitable sealing process, such, for example, as welding.

As shown, a tubulation 48 is preassembled to the central area of the foil sheet 46 for use in evacuating and backfilling the cavity within the panel. The tubulation includes a glass or metal tube 50 having an external annular flange sealed to the inner surface of the sheet 46. A screen 54 extends across the inner side of the flange 52 to prevent the blanket or parts thereof from being sucked into the tubulation during the evacuation process. After completion of the evacuation and backfilling process the tube 50 may be sealed in any well known manner such, for example, as by melting or crimping.

Figure 5:
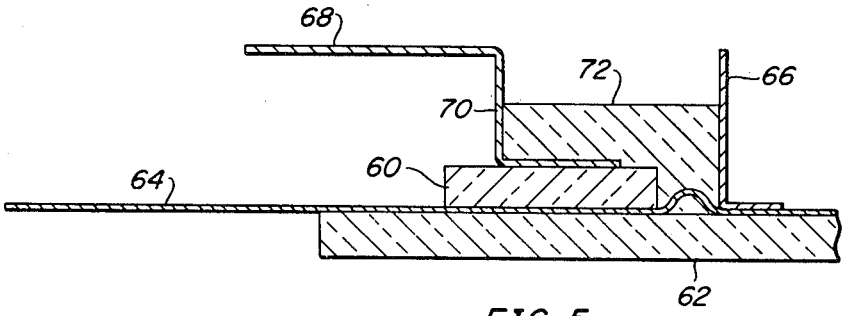
FIG. 5 is a fragmentary, cross-sectional view of still another flat-panel display embodying the present invention.

In FIG. 5 there is shown another panel construction wherein the edge flange member is used to form the moat for frit. In this embodiment of the invention the edge pieces 60 are placed on a glass pane 62 over the leads 64 as in the other embodiments of this invention described hereinabove. A metal foil member 66 is then mounted to the pane over the leads, as shown, and a continuous annular metal flange member 68 is mounted to the frame pieces 60. The flange member 68 has an intermediate reverse bend therein to provide an upstanding section 70 which functions as the outer wall of the moat in which the frit is placed. The panel assembly as thus partially fabricated is placed in an oven wherein the frit melts. After cooling, a sealing bead 72 provides a hermetic seal between the glass pane 62, the frame pieces 60, the leads 64 and the flange member 68. The inner moat member 66 is then removed as by peeling it off, and the panel is completed in the manner described in connection with the embodiment of the invention shown in FIGS. 4A and 4B.

Each metal flange member used in the several disclosed embodiments of the present invention is preferably a thin metal foil which does not exert any appreciable forces on the glass pane and frame pieces during and after the cooling process. However, somewhat thicker material can be used for the flange members, but in that case care must be taken to provide a good thermal match between the flange member and the frame pieces. Of course, the frame pieces and the glass pane should be thermally matched and are preferably adjacent pieces cut from the same sheet of glass.

Figure 6:
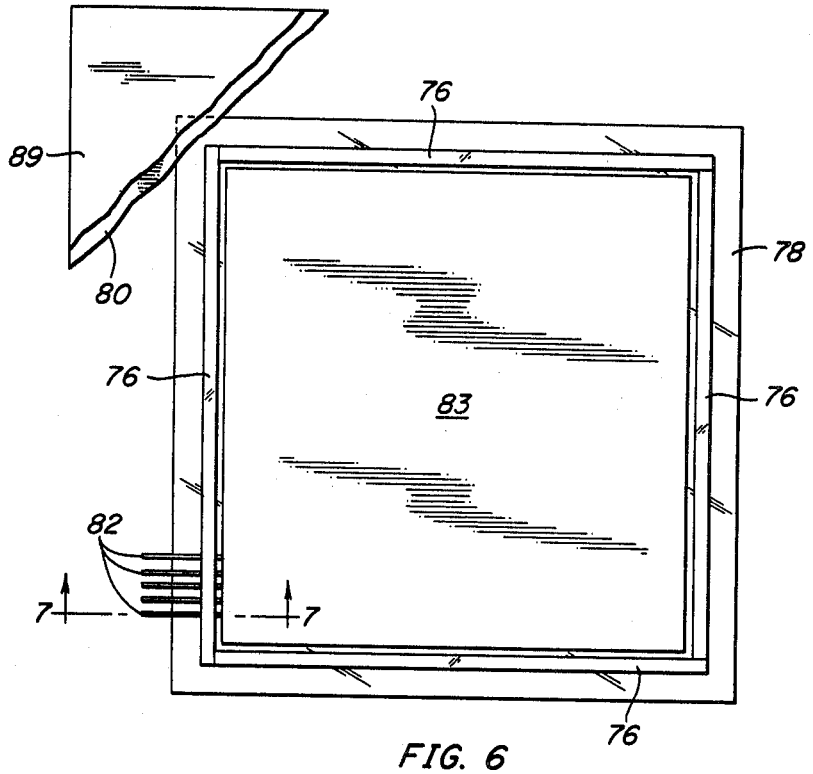
FIG. 6 is a plan view of another flat-panel display with the rear portions thereof partially removed.
Figure 7:
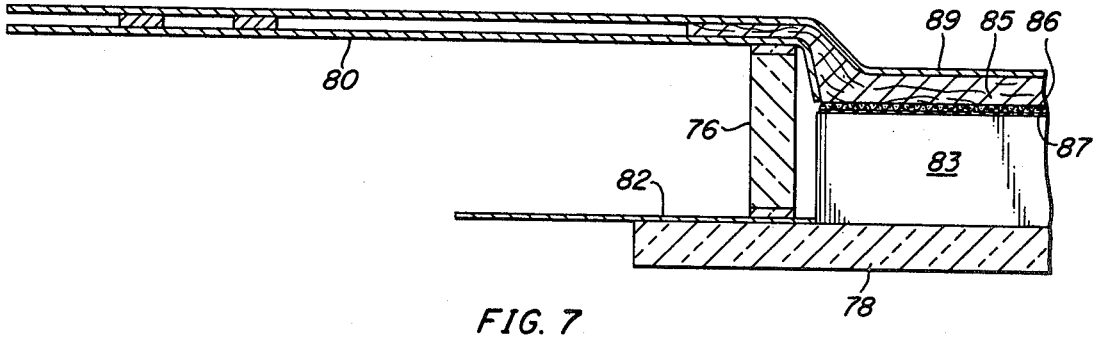
FIG. 7 is an enlarged cross-sectional view taken along the line 7—7 in FIG. 6 but showing a complete panel.

Referring to FIGS. 6 and 7 there is shown another embodiment of the invention wherein the frame extends above the electrode structure and the central portion of the rear sheet is depressed inwardly toward the electrode structure. This depression may be formed by the evacuation process or the rear sheet may be preformed before assembly thereof to the panel.

Considered in greater detail, a plurality of frame pieces 76 are initially sealed together at their adjoining edges to form a rectangular frame, and the frame is then placed on a glass pane 78 around the central viewing area in the manner shown in FIG. 6 and sealed to the pane 78 by frit or other suitable sealant. At this same time a continuous metal foil flange 80 may be sealed to the top edge of the frame. It will be understood that a plurality of conductors 82 may extend through the seal beneath the frame or through the frame. The conductors 82 may be pieces of wire or flat metal strips or they may be thick or thin films screened onto the pane or onto the frame pieces. Inasmuch as the internal operating structure of the panel is not yet in place, these sealing operations can be carried out at high temperatures. If desired, the frame may be a different insulating material, and it may be molded directly onto the pane 78.

After the frame has been sealed in place the electrode structure 83 may be placed against the pane 78 over the viewing area thereof. If the panel is to be operated at about atmospheric pressure, some means may be used to fixedly position the electrode structure 83 within the frame. A thin insulating sheet or blanket 87 may then be placed over the internal structure, a stress-distributing member of wire mesh or perforated metal 86 placed over this insulator, and a blanket 85 placed over the stress-distributing member. An impervious malleable sheet 89 is then placed over the blanket 85. If desired, insulator 87, metal member 86, or blanket 85 may be omitted. It may be seen that the flange 80 and the rear sheet 89 extend a substantial distance outwardly of the blanket and they are sealed together in any suitable manner such, for example, as by welding or by means of a sealant material which sets up at lower temperatures. Both the flange 80 and the sheet 89 may be thin metal foil so that they can be folded back over the panel.

Where the operating pressure in the panel is below atmospheric, the cavity therein is evacuated and back filled where necessary through a suitable tubulation which may, for example, extend through the rear sheet.

There is thus provided in accordance with the present invention an improved flat-panel display and method of manufacturing same. The front panel constitutes the principal support member with the remaining structure being compliant so as not to establish undue stresses in the front panel. The rear, impervious sheet is sealed to a continuous flange which itself is sealed to the panel through a continuous area surrounding the viewing area of the panel. While it is preferable to use a malleable rear sheet, either the rear sheet or the flange can be formed of a relatively stiff material. However, it is important that at least one of them be flexible or malleable to permit the rear sheet to be pressed toward the front panel against the operating display structure.

In the preferred embodiments of the invention described hereinabove, the flexible rear sheets are sealed to the flanges and then the cavity within the panel is exhausted and backfilled where necessary. However, for some applications of the invention it may be desirable to complete the seal between the rear sheet and the panel after the panel has been exhausted and backfilled.

In accordance with this aspect of the invention the panel is assembled and the rear sheet is not completely sealed to the flange, i.e., one or more gaps may be provided between the flange and the seal or the rear sheet and flange may not be sealed together at all. The panel is then placed in a vacuum oven and exhausted at an elevated temperature. The panel is then backfilled and the sheet and flange completely sealed together while the panel is still in the oven.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. A method of manufacturing a flat-panel display, comprising the steps of hermetically sealing an impervious flange to a continuous area of one surface of a panel member, said area surrounding a viewing area of said panel member, then positioning a display-producing structure against said one face of said panel member over said viewing area, then positioning an impervious sheet over said display producing structure, and then sealing said sheet to said flange along a continuous area surrounding said display-producing structure.

2. A method according to claim 1 wherein said flange is malleable, and comprising the further step of reducing the pressure between said sheet and said panel member below atmospheric.

3. A method according to claim 2 wherein said step of sealing said sheet to said flange is carried out after said step of reducing the pressure between said sheet and said panel.

4. A method according to claim 1 wherein, said step of sealing said flange to said panel member is carried out by sealing a continuous frame to said panel member and sealing said flange to said frame.

5. A method according to claim 4 wherein said frame and said panel member are glass, and said steps of sealing said frame to said panel member and said flange to said frame are carried out at temperatures at which said display-producing structure would be damaged if it were exposed thereto.

6. A method according to claim 5 comprising the step of placing a blanket over said display structure and said frame prior to said step of positioning said impervious sheet over said display producing structure.

7. A method according to claim 6 comprising the step of placing a stress distributing member over said blanket prior to said step of positioning said impervious sheet over said display producing structure.

* * * * *